US007537727B2

(12) United States Patent
Dilmore et al.

(10) Patent No.: US 7,537,727 B2
(45) Date of Patent: May 26, 2009

(54) EGLIN STEEL—A LOW ALLOY HIGH STRENGTH COMPOSITION

(75) Inventors: Morris Dilmore, Baker, FL (US); James D. Ruhlman, Santa Rosa Beach, FL (US)

(73) Assignee: Ellwood National Forge Company, Irvine, PA (US)

( * ) Notice: Subject to any disclaimer, the term of this patent is extended or adjusted under 35 U.S.C. 154(b) by 0 days.

(21) Appl. No.: 10/761,472

(22) Filed: Jan. 21, 2004

(65) Prior Publication Data

US 2004/0250931 A1 Dec. 16, 2004

Related U.S. Application Data

(60) Provisional application No. 60/444,261, filed on Jan. 31, 2003, provisional application No. 60/442,334, filed on Jan. 24, 2003.

(51) Int. Cl.
*C22C 38/22* (2006.01)
*C21D 6/00* (2006.01)

(52) U.S. Cl. ..... 420/114; 148/663; 420/105

(58) Field of Classification Search ..... 148/320, 148/335, 333, 334, 663; 420/109, 113, 111, 420/114, 106
See application file for complete search history.

(56) References Cited

U.S. PATENT DOCUMENTS

| | | | | | |
|---|---|---|---|---|---|
| 2,031,904 | A | | 2/1936 | Rittershausen et al. | |
| 2,942,339 | A | * | 6/1960 | Lyon | 29/468 |
| 3,068,095 | A | * | 12/1962 | Anthony, III et al. | 420/107 |
| 3,574,602 | A | * | 4/1971 | Gondo et al. | 420/82 |
| RE28,523 | E | * | 8/1975 | Hill et al. | 420/8 |
| 4,076,525 | A | | 2/1978 | Little et al. | |
| 4,102,711 | A | | 7/1978 | Kunitake et al. | |
| 4,170,497 | A | | 10/1979 | Thomas et al. | |
| 4,170,499 | A | | 10/1979 | Thomas et al. | |
| 4,203,782 | A | | 5/1980 | Yamada et al. | |
| 4,655,852 | A | | 4/1987 | Rallis et al. | |
| 4,729,872 | A | * | 3/1988 | Kishida et al. | 420/105 |
| 4,784,704 | A | | 11/1988 | Manton | |
| 4,832,909 | A | | 5/1989 | Schmidt et al. | |
| 5,019,459 | A | | 5/1991 | Chou et al. | |
| 5,180,450 | A | | 1/1993 | Rao | |
| 5,182,079 | A | | 1/1993 | Nelson | |
| 5,288,455 | A | | 2/1994 | Siga et al. | |
| 5,292,384 | A | | 3/1994 | Klueh et al. | |
| 5,305,505 | A | | 4/1994 | Ruhlman | |
| 5,454,883 | A | * | 10/1995 | Yoshie et al. | 148/320 |
| 5,616,187 | A | | 4/1997 | Nelson | |
| 5,695,576 | A | * | 12/1997 | Beguinot | 148/328 |
| 5,746,843 | A | | 5/1998 | Miyata et al. | |
| 5,766,376 | A | | 6/1998 | Hasegawa et al. | |
| 6,146,033 | A | | 11/2000 | Chang et al. | |
| 6,186,072 | B1 | | 2/2001 | Hickerson, Jr. et al. | |
| 6,402,863 | B1 | | 6/2002 | Spencer | |
| 6,423,155 | B1 | | 7/2002 | Chang et al. | |
| 6,494,970 | B1 | | 12/2002 | Ishii et al. | |

FOREIGN PATENT DOCUMENTS

| | | | |
|---|---|---|---|
| EP | 1 091 010 | A1 | 11/2001 |
| JP | 09-194998 | * | 7/1997 |
| KR | 9004845 | * | 6/1990 |
| WO | WO 2004/061145 | A1 | 7/2004 |

OTHER PUBLICATIONS

ASM Internation, Material Park Ohio, Metallographer's Guide; Practices and Procedures for Irons and Steels, Chapter 1, "Introduction to Steels and Cast Irons", p. 3, Table 1.1,1990.*

* cited by examiner

*Primary Examiner*—John P. Sheehan
*Assistant Examiner*—Jessee R. Roe
(74) *Attorney, Agent, or Firm*—K&L Gates LLP

(57) ABSTRACT

The present invention relates to a low alloy, low to medium carbon content, high strength, and high ductility steel composition. The present invention contains relatively low nickel content, yet exhibits high performance characteristics and is manufactured at a substantially lower cost than alloy compositions containing high levels of nickel.

16 Claims, No Drawings

EGLIN STEEL—A LOW ALLOY HIGH STRENGTH COMPOSITION

RELATED APPLICATION

This application claims benefit to U.S. Provisional Application Ser. No. 60/442,334, entitled "Eglin Steel—A Low Alloy High Strength Composition," filed Jan. 24, 2003 and to U.S. Provisional Application Ser. No. 60/444,261, also entitled "Eglin Steel—A Low Alloy High Strength Composition," filed Jan. 31, 2003 with the U.S. Patent and Trademark Office, the contents of which are hereby incorporated by reference in their entirety.

GOVERNMENT INTERESTS

The present invention was made in the course of a contract with the Department of the Air Force, and may be manufactured and used by or for the Government of the United States for all governmental purposes without the payment of a royalty. The Government may have rights in this invention.

TECHNICAL FIELD

The present invention relates to a low alloy, high strength steel composition having a low to medium carbon content and high ductility.

BACKGROUND OF THE INVENTION

There is a need in the art for a low cost, high strength, high performance steel composition. Such high strength, high performance steels have various applications in both the commercial and military industries. For example, commercial applications of high strength, high performance steels include the following: pressure vessels; hydraulic and mechanical press components; commercial aircraft frame and landing gear components; locomotive, automotive, and truck components, including die block steels for manufacturing of components; and bridge structural members. Exemplary military applications of high strength, high performance steels include hard target penetrator warhead cases, missile components including frames, motors, and ordnance components including gun components, armor plating, military aircraft frame and landing gear components.

One major disadvantage in the use of high strength, high performance steels in such applications is the relatively high cost of the steel, which is the result of the high alloy content and expensive related manufacturing processes associated with such high strength steels. To produce a high strength steel, prior art compositions have included high levels of nickel, which is an expensive element and contributes to the high overall cost of the final steel product. One prior art composition commonly designated as AF-1410, described in U.S. Pat. No. 4,076,525 hereby incorporated by reference, provides a high strength, high performance steel at an expensive cost due to the high weight percentage of nickel, which comprises about 9.5 to about 10.25 percent by weight of the entire AF-1410 steel composition. A need, therefore, exists for an improved low alloy, high strength, high performance steel composition that can be produced relatively inexpensively.

The present invention overcomes the existing need in the prior art by providing a low alloy, low to medium carbon content, and low nickel content steel composition, which exhibits the same desirable high performance characteristics of high strength steel compositions known in the prior art and which can be produced according to current "state-of-the-art" production techniques at substantially lower cost (ladle melting and refining versus vacuum melting and refining). The low carbon and low alloy content makes the steel composition of the present invention more easily welded and more easily heat-treated. Current bomb case materials are not generally weldable, whereas the bomb case material disclosed herein welds very easily. Weldability will increase the options for manufacturing bomb cases and, as a result, should significantly reduce overall production costs for this type of application.

The steel composition of the present invention has utility wherever high strength, high performance steel is desired. The low alloy, high strength steel composition of the present invention is particularly useful in projectile penetrator applications wherein high impact velocities, such as those greater than 1000 feet per second, are imparted to the projectile to cause deep penetration of rock and concrete barriers. The strength, toughness and wear resistance of the steel produced according to the present invention provides enhanced penetrator performance, while at the same time reduces manufacturing costs by using less of the more costly alloy materials such as nickel.

SUMMARY OF THE INVENTION

The present invention relates to a high strength and high ductility steel composition called "Eglin steel" having a low alloy and a low to medium carbon content. The Eglin steel composition of the present invention includes relatively low levels of nickel, yet maintains the high strength and high performance characteristics associated with steel compositions that contain high levels of nickel.

It is an object of the present invention to provide a low alloy, high strength steel composition that has a relatively low nickel content.

It is another object of the present invention to provide a low alloy, high strength steel composition that is manufactured by certain specific thermal processes to exhibit optimum mechanical properties.

It is yet another object of the present invention to provide a high performance steel composition that avoids the high production costs associated with high alloys.

It is still further an object of the present invention to produce a bomb case material that is weldable, so as to increase the options for manufacturing bomb cases and, consequently, significantly reduce overall production costs.

The foregoing and other features and advantages of the present invention will become more apparent in light of the following detailed description of the preferred embodiments thereof. While the invention will be described in connection with one or more preferred embodiments, it will be understood that it is not intended to limit the invention to those embodiments. On the contrary, it is intended that the invention cover all alternatives, modifications and equivalents as may be included within its spirit and scope as defined by the appended claims.

DETAILED DESCRIPTION OF THE INVENTION

The present invention is directed to a low alloy, low to medium carbon content, high strength, and high ductility steel composition termed "Eglin steel." Eglin steel contains a relatively low nickel content, yet exhibits high performance characteristics. Eglin steel, furthermore, is manufactured at a substantially lower cost than alloy compositions containing high levels of nickel.

The low alloy, Eglin steel of the present invention has the following weight percentages, as set forth in Table 1, below:

TABLE 1

| Element | Weight % |
|---|---|
| Carbon (C) | 0.16-0.35% |
| Manganese (Mn) | 0.85% Maximum |
| Silicon (Si) | 1.25% Maximum |
| Chromium (Cr) | 1.50-3.25% |
| Nickel (Ni) | 5.00% Maximum |
| Molybdenum (Mo) | 0.55% Maximum |
| Tungsten (W) | 0.70-3.25% |
| Vanadium (V) | 0.05-0.30% |
| Copper (Cu) | 0.50% Maximum |
| Phosphorous (P) | 0.015% Maximum |
| Sulfur (S) | 0.012% Maximum |
| Calcium (Ca) | 0.02% Maximum |
| Nitrogen (N) | 0.14% Maximum |
| Aluminum (Al) | 0.05% Maximum |
| Iron (Fe) | Balance |

Certain alloying elements of Eglin steel provide desirable properties. Silicon is included to enhance toughness and stabilize austenite. Chromium is included to enhance strength and hardenability. Molybdenum is included to enhance hardenability. Calcium is included as a sulfur control agent. Vanadium and nickel are included to increase toughness. Tungsten is included to enhance strength and wear resistance.

The alloy of the present invention can be manufactured by the following processes: (i) Electric Arc, Ladle Refined and Vacuum Treated; (ii) Vacuum Induction Melting; (iii) Vacuum Arc Re-Melting; and/or (iv) Electro Slag Re-Melting. The use of the end item will dictate the manufacturing process that should be applied. As an example, a limited use and low liability item is manufactured by using only the Electric Arc, Ladle Refined and Vacuum Treated manufacturing process. In another example, a medium use and medium liability item is manufactured by using either the Electric Arc, Ladle Refined and Vacuum Treated process or the Electric Arc, Ladle Refined, Vacuum Treated plus Vacuum Arc Re-Melting process. The Electric Arc, Ladle Refined, Vacuum Treated plus Electro Slag Re-Melting may also be included. In yet another example, a high use and high liability item such as an airframe component requires the Vacuum Induction Melting process, the Vacuum Arc Re-Melting process, or the Vacuum Induction Melting process, Vacuum Arc Re-Melting process and the Electro Slag Re-Melting manufacturing process. As the liability and number of manufacturing processes increase, the cost also increases. End products made from Eglin steel can be produced using open die forging, close die forging, solid or hollow extrusion methods, static or centrifugal castings, continuous casting, plate rolling, bar rolling or other conventional methods.

The present invention is explained and illustrated more specifically by the following non-limiting example.

EXAMPLE 1

Five sample heats (e.g., compositional variants termed ES-1 through ES-5) of the Eglin steel alloy composition of the present invention were produced according to the composition ranges in Table 1 above. The typical chemistry to obtain desired properties is listed below in Table 2 in the following weight percentages:

TABLE 2

| Element | C | Mn | P | S | Ni | Cr | Al | W | Si | Mo | N | V | Cu | Ca |
|---|---|---|---|---|---|---|---|---|---|---|---|---|---|---|
| Weight % | .28 | .74 | .012 | .003 | 1.03 | 2.75 | .011 | 1.17 | 1.00 | .36 | .0073 | .06 | .10 | .02 |

The samples were rolled into 1" thick plates and thermal processed according to the following process. First, the samples were normalized by: (i) charging the samples into a furnace below 500° F.; (ii) heating the samples at 125° F. maximum per hour to about 1725-1775° F.; (iii) holding the samples at 1750° F. for 1 hour per inch of section size; and (iv) allowing the samples to cool in air at room temperature. Second, the samples were austenitized by (i) charging the samples into a furnace below 500° F.; (ii) heating the samples at 125° F. maximum per hour to about 1675-1725° F.; and (iii) holding the samples at 1700° F. for 1 hour per inch of section size. Next, the samples were oil quenched to below 125° F. Lastly, the samples were tempered by (i) charging the samples into a furnace below 500° F.; (ii) heating the samples at 100° F. maximum per hour to about 490-510° F.; (iii) holding the samples at 500° F. for 1 hour per inch of section size; and (iv) allowing the samples to cool in air at room temperature.

The following tests were conducted: tensile strength, yield strength, elongation, reduction of area, Charpy V-Notch Impact, and the Hardness Rockwell C-scale. The results of these tests are depicted in Table 3, below.

TABLE 3

Mechanical Properties Table for Eglin Steel Test Series

| Composition | HR UTS ksi | HR YTS ksi | HR STF % | HRHT UTS ksi | HRHT YTS ksi | HRHT STF % | LR UTS ksi | LR YTS ksi | LR STF % | Hardness Rc | CI RT ft. lbs | CI −40° F. ft. lb. |
|---|---|---|---|---|---|---|---|---|---|---|---|---|
| ES-1 | 263.7 | 224.5 | 16.6 | 215.7 | 191.4 | 15.9 | 246.7 | 193.9 | 18.4 | 45.6 | 56.2 | 42.7 |
| std. dev. | 3.1 | 4.0 | 0.3 | 3.6 | 7.0 | 0.7 | 1.4 | 2.2 | 0.4 | 0.1 | 2.6 | 0.3 |

TABLE 3-continued

Mechanical Properties Table for Eglin Steel Test Series

| Composition | HR UTS ksi | HR YTS ksi | HR STF % | HRHT UTS ksi | HRHT YTS ksi | HRHT STF % | LR UTS ksi | LR YTS ksi | LR STF % | Hardness Rc | CI RT ft. lbs | CI −40° F. ft. lb. |
|---|---|---|---|---|---|---|---|---|---|---|---|---|
| ES-2 | 261.2 | 231.9 | 15.5 | 216.1 | 197.4 | 15.1 | 244.4 | 201.9 | 17.5 | 46.6 | 27.3 | 20.0 |
| std. dev. | 2.0 | 3.3 | 0.3 | 7.1 | 6.0 | 0.6 | 1.0 | 0.2 | 0.3 | 0.2 | 1.9 | 1.0 |
| ES-3 | 247.5 | 218.4 | 16.6 | 202.6 | 187.8 | 16.0 | 233.6 | 186.4 | 18.0 | 45.4 | 44.8 | 21.3 |
| std. dev. | 3.4 | 3.5 | 0.5 | 2.0 | 2.7 | 1.0 | 0.7 | 1.1 | 0.2 | 0.2 | 2.8 | 3.9 |
| ES-4 | 264.3 | 229.0 | 16.3 | 218.4 | 198.0 | 16.0 | 248.3 | 199.1 | 17.5 | 46.5 | 39.6 | 24.2 |
| std. dev. | 1.6 | 4.5 | 0.4 | 1.2 | 2.1 | 0.8 | 1.4 | 0.6 | 0.4 | 0.2 | 0.6 | 3.6 |
| ES-5 | 291.9 | 244.8 | 15.1 | 233.3 | 210.6 | 15.2 | 270.2 | 216.0 | 16.6 | 48.3 | 26.2 | 22.3 |
| std. dev. | 0.8 | 5.5 | 0.5 | 2.1 | 0.5 | 0.3 | 1.1 | 1.6 | 0.3 | 0.18 | 2.2 | 0.8 |

HR UTS-High Rate Ultimate Tensile Strength
HR YTS-High Rate Yield Tensile Strength
HR STF-High Rate Strain-To-Failure
HRHT UTS-High Rate High Temperature (900° F.) Ultimate Tensile Strength
HRHT YTS-High Rate High Temperature (900° F.) Yield Tensile Strength
HRHT STF-High Rate High Temperature (900° F.) Strain-To-Failure
LR UTS-Low Rate Ultimate Tensile Strength
LR YTS-Low Rate Ultimate Yield Strength
LR STF-Low Rate Strain-To-Failure
Hardness Rockwell "C"
CI, RT-Charpy "V" Notch Impact @ Room Temperature
CI, −40° F.-Charpy "V" Notch Impact @ −40° F.

EXAMPLE 2-5

Sample heats of the Eglin steel alloy composition of the present invention were produced according to the composition ranges in Table 1 above. The samples were thermal processed according to the following processes.

EXAMPLE 2

First, the samples were normalized by: (i) charging the samples into a furnace below 500° F.; (ii) heating the samples at 900° F. maximum per hour to about 1725-1775° F.; (iii) holding the samples at 1750° F. for 1 hour per inch of section size; and (iv) allowing the samples to cool in air at room temperature. Second, the samples were austenitized by (i) charging the samples into a furnace below 500° F.; (ii) heating the samples at 900° F. maximum per hour to about 1675-1725° F.; and (iii) holding the samples at 1700° F. for 1 hour per inch of section size. Next, the samples were helium or nitrogen gas quenched to below 125° F. Lastly, the samples were tempered by (i) charging the samples into a furnace below 500° F.; (ii) heating the samples at 100° F. per hour to about 490-510° F.; (iii) holding the samples at 500° F. for 1 hour per inch of section size; and (iv) allowing the samples to cool in air at room temperature.

EXAMPLE 3

First, the samples were normalized by: (i) charging the samples into a furnace below 500° F.; (ii) heating the samples at 125° F. maximum per hour to about 1725-1775° F.; (iii) holding the samples at 1750° F. for 1 hour per inch of section size; and (iv) allowing the samples to cool in air at room temperature. Second, the samples were austenitized by (i) charging the samples into a furnace below 500° F.; (ii) heating the samples at 125° F. maximum per hour to about 1675-1725° F.; and (iii) holding the samples at 1700° F. for 1 hour per inch of section size. Next, the samples were quenched by (i) still air cooling the samples to about 975-1025° F.; and (ii) oil quenching the samples to below 125° F. Lastly, the samples were tempered by (i) charging the samples into a furnace below 500° F.; (ii) heating the samples at 100° F. maximum per hour to about 490-510° F.; (iii) holding the samples at 500° F. for 1 hour per inch of section size; and (iv) allowing the samples to cool in air at room temperature.

EXAMPLE 4

First, the samples were normalized by: (i) charging the samples into a furnace below 500° F.; (ii) heating the samples at 900° F. maximum per hour to about 1725-1775° F.; (iii) holding the samples at 1750° F. for 1 hour per inch of section size; and (iv) allowing the samples to cool in air at room temperature. Second, the samples were austenitized by (i) charging the samples into a furnace below 500° F.; (ii) heating the samples at 900° F. maximum per hour to about 1675-1725° F.; and (iii) holding the samples at 1700° F. for 1 hour per inch of section size. Next, the samples were quenched by (i) simulating air-cooling the samples with helium or nitrogen to about 975-1025° F.; and (ii) helium or nitrogen gas quenching the samples to below 125° F. Lastly, the samples were tempered by (i) charging the samples into a furnace below 500° F.; (ii) heating the samples at 100° F. maximum per hour to about 490-510° F.; and (iii) holding the samples at 500° F. for 1 hour per inch of section size.

EXAMPLE 5

First, the samples were normalized by: (i) charging the samples into a furnace below 500° F.; (ii) heating the samples at 125° F. maximum per hour to about 1725-1775° F.; (iii) holding the samples at 1750° F. for 1 hour per inch of section size; and (iv) allowing the samples to cool in air at room temperature. Second, the samples were austenitized by (i) charging the samples into a furnace below 500° F.; (ii) heating the samples at 125° F. maximum per hour to about 1675-1725° F.; and (iii) holding the samples at 1700° F. for 1 hour per inch of section size. Next, the samples were quenched by (i) still air cooling the samples to about 975-1025° F.; and (ii) water quenching the samples to below 125° F. Lastly, the samples were tempered by (i) charging the samples into a furnace below 500° F.; (ii) heating the samples at 100° F.

maximum per hour to about 490-510° F.; (iii) holding the samples at 500° F. for 1 hour per inch of section size; and (iv) cooling the samples in air at room temperature.

In addition to the specific examples noted above, it has been found that improved mechanical properties and/or process efficiencies can be realized by one or more of the following: (i) eliminating the normalizing operation, (ii) varying austenitization times and temperatures, (iii) quenching in a variety of media, including water, polymer solutions oil, pressurized nitrogen or helium, and air, (iv) varying tempering temperatures from about 300-600° F., and (v) varying tempering times.

Various modifications of the present invention in addition to those shown and described herein will be apparent to those skilled in the art from the foregoing description. Such modifications are also intended to fall within the scope of the appended claims.

We claim:

1. An alloy steel in weight percentage consisting of from about 0.16% to about 0.35% carbon, about 0.85% maximum manganese, an amount of silicon up to about 1.25% maximum, about 1.50% to about 3.25% chromium, about 5.00% maximum nickel, about 0.55% maximum molybdenum, 1.17% to about 3.25% tungsten, about 0.05% to about 0.30% vanadium, about 0.50% maximum copper, about 0.015% maximum phosphorous, about 0.012% maximum sulfur, about 0.02% maximum calcium, about 0.14% maximum nitrogen, about 0.05% maximum aluminum, and balance consisting essentially of iron, wherein said alloy steel has an ultimate tensile strength level of 233-270 ksi, Charpy V-notch impact strength of 20-43 ft-lb at -40° F. and a ductility low rate strain-to-failure of 16.6 to about 18.4%.

2. The alloy steel recited in claim 1 wherein said steel has an ultimate tensile strength level of about 244 ksi.

3. The alloy steel recited in claim 1 wherein said steel has an ultimate tensile strength level of 234 ksi.

4. The alloy steel recited in claim 1 wherein said steel has an ultimate tensile strength level of about 270 ksi.

5. The alloy steel recited in claim 1 wherein said steel has an ultimate tensile strength level of about 248 ksi.

6. A bomb casing material comprising the alloy steel in weight percentage as in claim 1.

7. An alloy steel in weight percentage consisting of about 0.28% carbon, about 0.74% manganese, about 0.012% phosphorus, about 0.003% sulfur, about 1.03% nickel, about 2.75% chromium, about 0.011% aluminum, about 1.17% tungsten, about 1% silicon, about 0.36% molybdenum, about 0.0073% nitrogen, about 0.06% vanadium, about 0.1% copper, about 0.02% calcium, and balance essentially iron, wherein said alloy steel has an ultimate tensile strength level of 233- 270 ksi and Charpy V-notch impact strength of 20-43 ft-lb at -40° F.

8. The alloy steel recited in claim 7 wherein said steel has an ultimate tensile strength level of about 247 ksi.

9. A bomb casing material comprising the alloy steel in weight percentage as in claim 7.

10. An alloy steel in weight percentage consisting of about 0.28% carbon, an amount of manganese up to about 0.85% maximum, about 1.00% silicon, about 1.50% to about 3.25% chromium, about 1.03% nickel, an amount of molybdenum up to about 0.55% maximum, about 1.17% tungsten, about 0.05% to about 0.30% vanadium, an amount of copper up to about 0.50% maximum, an amount of phosphorous up to about 0.015% maximum, an amount of sulfur up to about 0.012% maximum, about 0.02% calcium, an amount of nitrogen up to about 0.14% maximum, an amount of aluminum up to about 0.05% maximum, and balance consisting of iron, wherein said alloy steel has an ultimate tensile strength level of about 233-270 ksi and Charpy V-notch impact strength of about 20-43 ft-lb at -40° F.

11. The alloy steel recited in claim 10 wherein said steel has an ultimate tensile strength level of about 247 ksi.

12. The alloy steel recited in claim 10 wherein said steel has a ductility low rate strain-to-failure of 16.6 to about 18.4%.

13. A bomb casing material comprising the alloy steel in weight percentage as in claim 10.

14. An alloy steel in weight percentage consisting of about 0.28% carbon, about 0.74% manganese, about 0.012% phosphorus, about 0.003% sulfur, about 1.03% nickel, about 2.75% chromium, about 0.011% aluminum, about 1.17% tungsten, about 1% silicon, about 0.36% molybdenum, about 0.0073% nitrogen, about 0.06% vanadium, about 0.1% copper, about 0.02% calcium, and balance essentially iron, wherein said alloy steel has an ultimate tensile strength level of about 244-270 ksi and Charpy V-notch impact strength of about 20-43 ft-lb at -40° F.

15. An alloy steel in weight percentage consisting of from about 0.16% to about 0.35% carbon, about 0.85% maximum manganese, an amount of silicon up to about 1.25% maximum, about 1.50% to about 3.25% chromium, about 5.00% maximum nickel, about 0.55% maximum molybdenum, about 0.70% to about 3.25% tungsten, about 0.05% to about 0.30% vanadium, about 0.50% maximum copper, about 0.015% maximum phosphorous, about 0.012% maximum sulfur, about 0.02% maximum calcium, about 0.14% maximum nitrogen, about 0.05% maximum aluminum, and balance consisting essentially iron, wherein said alloy steel has an ultimate tensile strength level of 233-270 ksi, Charpy V-notch impact strength of 20-43 ft-lb at -40° F and a ductility low rate strain to failure of 16.6 to 18.4%.

16. A bomb casing material comprising the alloy steel in weight percentage as in claim 15.

* * * * *